United States Patent [19]

Trin

[11] Patent Number: 4,717,119

[45] Date of Patent: Jan. 5, 1988

[54] DEVICE FOR BLEEDING OR FOR DRAINING A HEAT EXCHANGER, SUCH AS A RADIATOR FOR A MOTOR VEHICLE

[75] Inventor: Pierre Trin, Maurepas, France

[73] Assignee: Valeo, Paris, France

[21] Appl. No.: 13,589

[22] Filed: Feb. 11, 1987

[51] Int. Cl.[4] ..... F16K 31/524; B65D 41/02

[52] U.S. Cl. ..... 251/144; 74/56; 220/300; 220/304; 251/252

[58] Field of Search ..... 74/56, 57; 220/293, 220/298, 300, 301, 304; 251/144, 251, 252

[56] References Cited

U.S. PATENT DOCUMENTS

| | | | |
|---|---|---|---|
| 858,771 | 7/1907 | Whitehouse | 251/252 |
| 3,578,285 | 6/1969 | Carlton | 251/144 |
| 3,811,650 | 5/1974 | Dehar | 251/144 |
| 3,910,550 | 10/1975 | Nelson | 251/144 |
| 3,913,783 | 10/1975 | Cooper | 220/300 |
| 4,099,645 | 7/1978 | Muth et al. | 220/304 |
| 4,193,575 | 3/1980 | Burgess | 251/144 |

FOREIGN PATENT DOCUMENTS

| | | | |
|---|---|---|---|
| 2112553 | 6/1972 | France . | |
| 2549532 | 7/1983 | France | 165/71 |

*Primary Examiner*—George L. Walton
*Attorney, Agent, or Firm*—Dennison, Meserole, Pollack & Scheiner

[57] ABSTRACT

The device comprises a stopper having an operating head (10), an intermediate portion (12) bearing a sealing ring, and a tail (14) formed with radial ribs which co-operate with slopes in the orifice in which the stopper is to be mounted, a portion (30) of said radial ribs being obliquely oriented so that rotation of the stopper about its axis gives rise to longitudinal translation along said axis. The invention is particularly applicable to devices for bleeding or for emptying the radiators of motor vehicles.

12 Claims, 11 Drawing Figures

DEVICE FOR BLEEDING OR FOR DRAINING A HEAT EXCHANGER, SUCH AS A RADIATOR FOR A MOTOR VEHICLE

The present invention relates to a device for bleeding or draining a heat exchanger, such as a radiator for a motor vehicle, in particular.

BACKGROUND OF THE INVENTION

Such a heat exchanger generally comprises at least one water box mounted at one end of a bundle of tubes through which a fluid flows, for example the cooling fluid of the internal combustion engine in a motor vehicle. It is conventional to provide an orifice through the wall of the water box and to close said orifice by means of a stopper including an operating head, an intermediate portion having a sealing ring mounted thereon, and a tail formed with radial ribs which constitute slopes that co-operate with complementary slopes on the edge of the orifice in the water box to enable the stopper to be mounted in the orifice and held in a sealed closure position therein.

The present Assignee's published French patent application No. 83 12 211, now French Pat. No. 2,549,532 describes a device of this type for a water box molded in plastic material in which the slopes at the orifice through the wall of the water box are plane and extend in the same plane as the orifice itself, thereby facilitating unmolding. The complementary slopes formed on the tail of the stopper are L-shaped and comprise a first plane portion perpendicular to the axis of the stopper tail and a second plane portion parallel to said axis and constituting an abutment which determines the closure position of the stopper in the orifice.

In order to bleed or drain the heat exchanger, the stopper is rotated, e.g. through one-quarter of a turn from said closure position. The stopper must then be drawn outwardly in translation along its axis in order to enable said bleeding or draining of the heat exchanger to take place. This last operation is by no means obvious to an uninstructed person. Further, the sealing ring provided around the intermediate portion of the stopper bears against a cylindrical surface of the water box wall formed around the orifice, so that friction between said sealing ring and said cylindrical surface opposes easy extraction of the stopper. If a person persists in attempting to turn the stopper about its axis instead of withdrawing it along its axis, the stopper may be damaged.

The aim of the present invention is to provide a device of the type described in the Assignee's prior patent, while avoiding the above-specified drawbacks.

SUMMARY OF THE INVENTION

To this end, the invention provides a device for bleeding or draining a heat exchanger, such as the radiator of a motor vehicle, said device comprising a removable stopper suitable for closing in sealed manner an orifice formed through the wall of a water box of the heat exchanger, the stopper comprising an operating head and a tail formed with diametrically opposite radial ribs extending over limited angular sectors and each comprising a first portion which is parallel to the axis of the stopper tail and a second portion which is perpendicular to said axis, with the radially inner edge of the orifice being formed with diametrically opposite radial notches determining plane projections therebetween suitable for co-operating with the radial ribs of the stopper tail in order to hold it in an orifice closure position, the device including the improvement whereby each radial rib of the stopper tail includes a third portion extending obliquely or helically around the axis towards the free end of the stopper tail from the second portion of the rib and constituting a sloping ramp suitable for co-operating with a radial edge of a projection from the edge of the orifice in order to displace the stopper in translation along its axis while it is rotated about its axis from its orifice closure position.

Thus, by rotating the stopper, the stopper is caused to move in translation along its axis so that it is automatically brought from its position of sealed orifice closure to its bleeding or draining position.

Preferably, each of the above-specified radial ribs terminates, in the vicinity of the free end of the stopper tail, in a fourth position extending parallel to the second portion and making an acute angle with said third portion in order to form a catch co-operating with the radial projection from the orifice and retaining the stopper at the end of its opening motion.

In this way, the stopper cannot be completely removed from the orifice at the end of its opening motion and cannot therefore be lost. After the heat exchanger has been bled or drained, all that remains to be done is to turn the stopper in the opposite direction about its axis in order to return it automatically to the sealed closure position of the orifice through the wall of the water box.

Further, if it is really desired that the stopper should be completely removed from the orifice, all that needs to be done is to rotate it through a fraction of a turn in the opposite direction and then it can be pulled out axially.

In accordance with another characteristic of the invention, the free end of the stopper tail may include resiliently deformable fingers extending parallel to the axis of the stopper and terminating in hooks which are directed radially outwardly.

This provides a stopper of the un-loseable type which can be mounted in the orifice without difficulty but which is impossible to remove from the orifice by virtue of its end hooks engaging under the edges of the orifice through the wall in the water box.

In accordance with another characteristic of the invention, the head of the stopper may include two outwardly projecting radial pegs which are diametrically opposite each other and which are suitable for being received in diametrically opposite notches in the inside surface of a collar surrounding the orifice through the wall of the water box in order to positively define the closure position of the stopper.

The stopper is advantageously a half-turn type stopper, i.e. it is a stopper which is moved from its closure position to its bleed or drain position, and vice versa, by being rotated through one-half of a turn about its axis.

BRIEF DESCRIPTION OF THE DRAWINGS

Embodiments of the invention are described by way of example with reference to the accompanying drawings, in which.

MORE DETAILED DESCRIPTION

Figure 1:
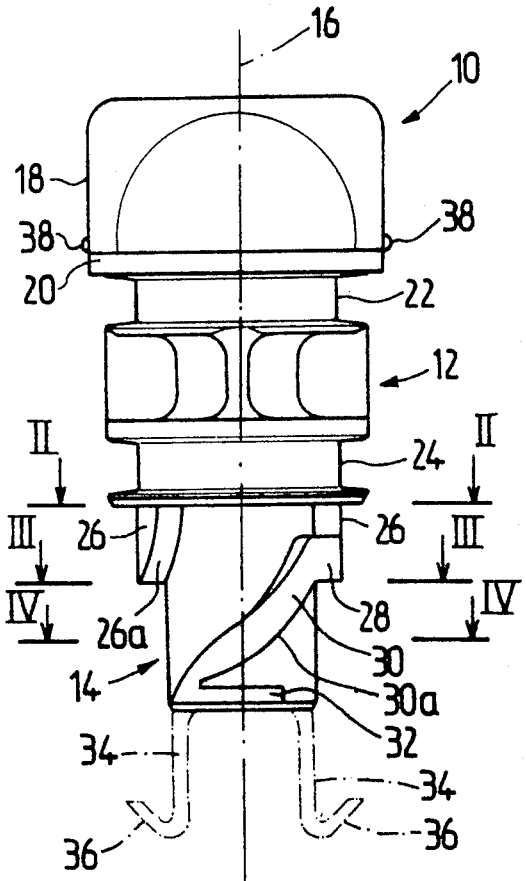
FIG. 1 is an elevation view of a stopper in accordance with the invention.

Reference is made initially to FIGS. 1 to 6 which show the stopper of a device in accordance with the invention.

This stopper is molded, for example, as a single piece of plastic material and comprises an operating head 10, an intermediate portion 12, and a tail 14, with all three portions being generally cylindrical in shape about a longitudinal axis 16.

More precisely, the operating head 10 comprises a rectangular plane portion 18 connected via a portion 20 in the shape of a circular disk to the intermediate portion 12 of the stopper. At its ends, this intermediate portion comprises two identical annular grooves 22 and 24, one of which receives an annular sealing ring. Each annular groove 22 and 24 is delimited by two annular faces extending perpendicularly to the axis 16 such that the sealing ring disposed in one or other of the grooves is not compressed in a direction parallel to the axis 16 when the stopper is mounted in sealed manner in an orifice through the wall of a water box.

The tail 14 of the stopper is generally cylindrical in shape about the axis 16 and includes radially projecting ribs on its cylindrical outer surface for co-operating with radial projections from the inside edge of the orifice, in a manner described below.

In the example shown, there are two of these ribs, and they are diametrically opposite each other. Each of the ribs comprises, starting from the annular end face of the groove 24, a first portion 26 which extends parallel to the axis 16, a second portion 28 which extends perpendicularly to said axis, a third portion 30 which extends helically around the outer peripheral surface of the tail of the stopper through an angle of about 90° about the axis 16, and a fourth portion 32 which is parallel to the second portion 28, i.e. perpendicular to the axis 16, and which is at an acute angle to the third portion 30 of the rib.

The back 26*a* of the first portion 26 of each of the ribs is substantially parallel to the back 30*a* of the third portion 30, and extends helically over the surface of the stopper tail through an angle of about 40° or 45°.

As shown in dot-dashed lines in FIG. 1, the free end of the stopper tail 14 may be formed during molding with two resiliently deformable fingers 34 which extend parallel to the axis 16 of the stopper and which are terminated by hooks 36 which curve back outwardly. The two fingers 34 are diametrically opposite each other and the distance between the radially outer ends of their hooks 36 is greater than the diameter of the orifice to be closed by said stopper.

Figure 5:
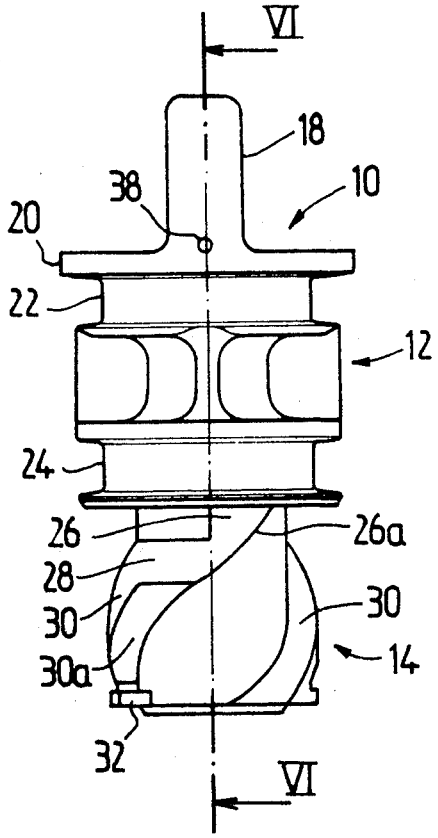
FIG. 5 is a side view of the FIG. 1 stopper.
Figure 2:
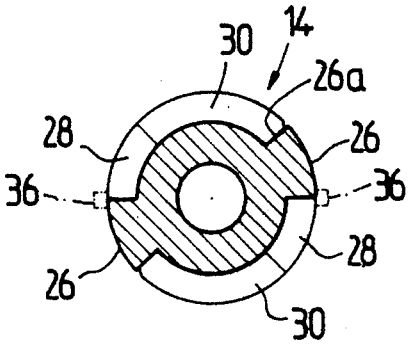
FIGS. 2, 3, and 4 are cross-sections through the FIG. 1 stopper on lines II—II, III—III, and IV—IV of FIG. 1 respectively.
Figure 3:
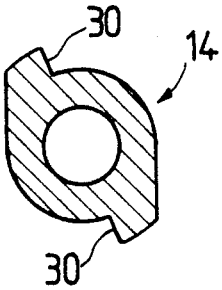
Figure 4:
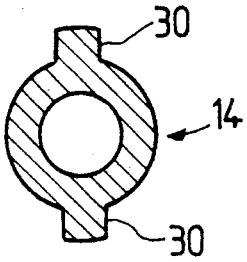
Figure 6:
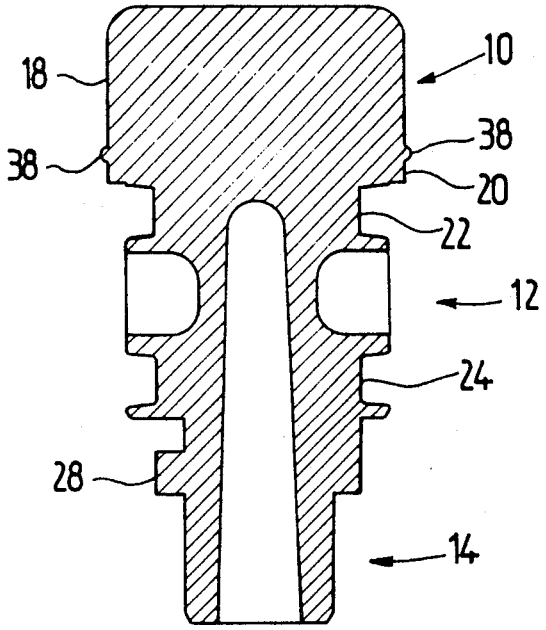
FIG. 6 is an axial section through a stopper taken on a line VI—VI of FIG. 5.

As can be seen in FIGS. 2, 3, 4, and 6, the intermediate portion 12 of the stopper and the tail 14 are tubular, thereby lightening the stopper and saving raw material. Further, as can be seen in FIGS. 1, 5, and 6, the head 10 of the stopper is formed with two diametrically opposite, hemi-spherical pegs 38 on either side of the axis 16, which pegs are located at the base of the rectangular portion 18 of the head 10 and project outwardly from the periphery of the annular portion 20 of the head 10.

Figure 7:
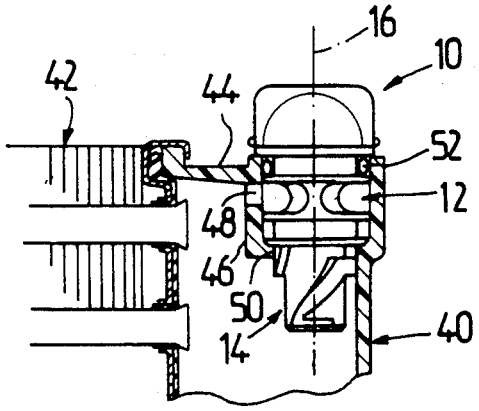
FIG. 7 shows a first way of mounting said stopper in an orifice through the wall of water box of a heat exchanger.

Reference is now made to FIG. 7 which shows an example of said stopper being mounted in an orifice through the wall of a water box in a heat exchanger.

The water box, given the reference 40, is conventionally mounted at one end of a bundle of tubes 42 in a heat exchanger.

The top wall 44 is integrally molded with a bleed duct comprising a cylindrical orifice formed through the top wall 44, a cylindrical collar 46 around said orifice and extending vertically inside the water box 40, and a radial hole 48 formed through the cylindrical wall of the collar 46 immediately below the top wall 44 of the water box. The bottom end of the collar 46 delimits an orifice 50 for receiving the tail 14 of the stopper when the stopper is mounted in the bleed duct in order to close it in sealed manner. The inside edge of the orifice 50 has radial projections described below with reference to FIGS. 8 to 10, and which co-operate with radial ribs on the tail of the stopper, firstly to hold the stopper in its sealed closure position, and secondly to guide displacement of the stopper between said sealed closure position and its bleed position where it is partially moved out from said bleed duct.

In this embodiment, a sealing ring 52 is placed in the upper annular groove 22 of the intermediate portion 12 of the stopper. This sealing ring 52 presses against the top end of the internal cylindrical surface of the collar 46, thereby insulating the radial orifice 48 formed through the collar 46 from the outside when the stopper is in its sealed closure position as shown in FIG. 7.

When the stopper is moved to its bleed position, by rotation through one-half of a turn anti-clockwise about the axis 16, the sealing ring 52 received in the upper groove 22 of the stopper is displaced upwardly and leaves the collar 46. The inside of the water box 40 is thus put into communication with the outside via the radial hole 48 through the collar 46 and the free space between the inside surface of the collar and the intermediate portion 12 of the stopper. This makes it possible to bleed off the air or gas contained in the liquid circulating through the heat exchanger.

Figure 9:
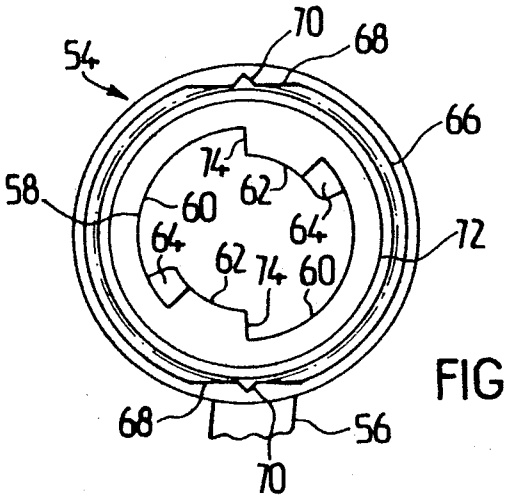
FIG. 9 is a left-hand view of the portion of the wall shown in FIG. 8.
Figure 8:
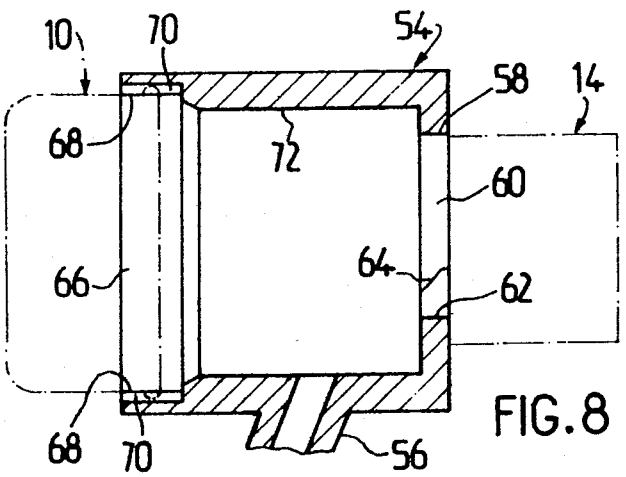
FIG. 8 is an axial section through another embodiment of a portion of the wall of a water box including an orifice for closure by said stopper.

Reference is now made to FIGS. 8 and 9 which show another embodiment of the cylindrical collar for receiving the stopper.

When used for draining purposes the cylindrical collar 54 shown in FIGS. 8 and 9 is formed in the bottom of the water box and on the outside thereof. It advantageously comprises an integrally molded bottom duct 56 which opens out to the inside of the collar 54 between ends thereof and which forms a liquid drain duct.

The water box end of the collar 54 includes an orifice 58 coaxial therewith and which has an inside edge with two diametrically opposite radial notches 60 separated from each other by two diametrically opposite radial projections 62 pointing into the orifice. One of the radial sides of each of the projections 62 is chamfered, as shown at 64, in order to constitute an inclined slope for co-operating with the back of a radial rib on the stopper tail.

At its opposite end to the orifice 58, the cylindrical collar 54 is formed with a recess 66 having two diametrically opposite flats 68 with V-shaped notches 70 in the middle of each flat 68. The two notches 70 are intended to receive the hemi-spherical pegs 38 projecting from the periphery of the head 10 of the stopper, thereby positively defining the sealed closure position of the stopper.

Between its ends, the cylindrical inside surface 72 of the collar 54 is of smaller diameter than the recess 66 and of slightly larger diameter than the intermediate portion 12 of the stopper.

The stopper for mounting in the collar is provided with sealing ring mounted in the lower groove 24 of the intermediate portion 12 of the stopper. When the stopper is in its sealed closure position for closing the orifice 58, this sealing ring is compressed readily against the inside surface 72 of the collar between the end of said collar having the orifice 58 and the point where the drain duct 56 opens out into the collar. In this position, the two hemi-spherical pegs 38 of the stopper head 10 are engaged in the notches 70 at the outside end of the collar 54. The second portions 28 of the radial ribs on the stopper tail are engaged beneath the radial projections 62 from the inside edge of the orifice 58, and the first portions 26 of these ribs abut against the radial sides 73 of the radial projections 62, i.e. the sides which are opposite to the sloping sides 64 thereof. When the stopper is rotated about its axis in the unscrewing direction, i.e. anti-clockwise, the sloping backs **26*a* of the first portions 26 of the ribs on the stopper tail press against the sloping sides 64 of the radial projections into the orifice, thereby generating a first motion of the stopper along its axis and out from the coller 54. Then, as stopper rotation about its axis continues, the backs 30*a* of the third portions 30 of the radial ribs on the stopper tail slide over the sloping sides 64 of the radial projection 62 into the orifice until the fourth portions 32 of the stopper tail ribs are engaged beneath the radial projections 62, thereby preventing the stopper from rotating. In this position, the stopper has moved far enough out from the collar 54 for the sealing ring in its annular groove 24 to have moved past the open end of the drain duct 56. The liquid contained in the water box can thus be drained off via said duct 56**.

The stopper is returned to its sealed closure position in the orifice 58 simply by being rotated through about one-half of a turn in the screwing or clockwise direction.

Figure 11:
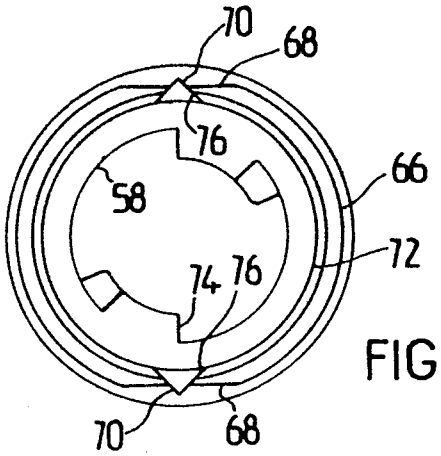
FIGS. 10 and 11 are views corresponding to FIGS. 8 and 9, but representing a different embodiment.
Figure 10:
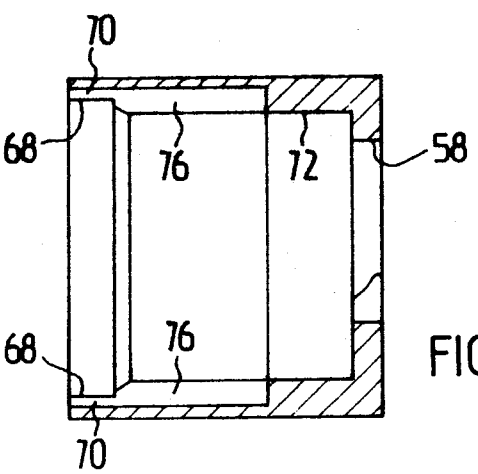

The variant embodiment shown in FIGS. 10 and 11 relates to a bleeder and differs from the embodiment shown in FIGS. 8 and 9 in that the communication between the orifice 58 and the outside is no longer provided by a duct 58 passing through the cylindrical wall of the collar, but by two diametrically opposite longitudinally extending grooves 76 formed in the inside cylindrical surface 72 of the collar and extending from the outside end of the collar down to a distance above its opposite end having the orifice 58. As can be seen, the grooves 76 are V-shaped in cross-section and are formed as an extension of the grooves or notches 70 formed in the flats 68 in order to receive the hemi-spherical pegs on the stopper head.

The remainder of the structure of the cylindrical collar shown in FIGS. 10 and 11 is identical to the collar shown in FIGS. 8 and 9.

When the stopper is mounted in this cylindrical collar in its position for closing the orifice 58 in sealed manner, the sealing ring received in its annular groove 24 isolates the orifice 58 from the longitudinally extending grooves 76. When the stopper is unscrewed through a half turn, the sealing ring moves past the ends of the longitudinally extending grooves 76 which are thus put into communication with the orifice 58. The heat exchanger can thus be bled.

The stopper has been described as having two sealing rings received in annular grooves at opposite ends of its intermediate portion 12. Naturally, this portion could be fitted with only one groove, located in the appropriate place for its intended function.

What is claimed is:

1. A device for bleeding or draining a heat exchanger, such as radiator for a motor vehicle, the device comprising a removable stopper suitable for closing in sealed manner an orifice formed in the wall of the heat exchanger water box, the stopper comprising means defining a limit stop for a closed or open position, an operating head, and a tail formed with diametrically opposite radial ribs, said ribs following limited angular sectors and comprising a first portion parallel to the axis of the stopper tail and a second portion perpendicular to said axis, the radially inside edge of the orifice being formed with diametrically opposite radial notches defining plane projections therebetween suitable for co-operating with the radial ribs on the stopper tail in order to hold it in its orifice closure position, the device including the improvement whereby each radial rib on the stopper tail includes a third portion extending obliquely or helically around the axis towards the free end of the stopper tail from said second portion of the rib, and constituting a sloping ramp suitable for co-operating with a radial side of a projection from the edge of the orifice in order to displace the stopper in translation along its axis when it is rotated about said axis from its position in which it closes the orifice in sealed manner and means directly extending from the third portion for retaining association of said stopper with said heat exchanger and for controlling the bleeding or draining of the heat exchanger.

2. A device according to claim 1, wherein each radial rib terminates, in the vicinity of the free end of the stopper tail, said means includes a fourth portion which extends parallel to the second portion and which makes an acute angle with the third portion in order to form a catch which co-operates with the radial projections from the orifice in order to retain the stopper at the end of its opening motion.

3. A device according to claim 1, wherein the back of the first portion of each radial rib is inclined obliquely or helically relative to the axis of the stopper tail, substantially parallel to the back of the third portion of the rib.

4. A device according to claim 1, wherein the free end of the stopper tail includes resiliently deformable fingers extending parallel to the stopper axis and terminated by radially outwardly directed hooks.

5. A device according to claim 1, wherein the stopper includes an intermediate portion between its head and its tail, said intermediate portion being formed with two parallel annular grooves disposed at an axial distance from each other, and with one of said groove having a sealing ring mounted therein for co-operating with the cylindrical inside surface of a collar surrounding the orifice through the water box.

6. A device according to claim 5, wherein the collar projects outwardly from the water box wall and includes longitudinally extending grooves in its inside cylindrical face, each of said grooves having one end opening out to the outside and having its other end at a distance from said orifice such that said longitudinally extending grooves are isolated from the orifice by the sealing ring when the stopper is in its closure position, and communicate with the orifice when the stopper is in its open position.

7. A device according to claim 5, wherein said collar includes a duct communicating with the outside and passing through its wall to open out in the inside face thereof, said duct being isolated from the orifice through the water box wall by the stopper sealing ring when the stopper is in its closure position and being in communication with said orifice when the stopper is in its open position.

8. A device according to claim 5, wherein the collar surrounding the orifice projects into the water box and includes a radial hole communicating with the inside of the water box, said radial hole being isolated from the outside by the sealing ring when the stopper is in its sealed closure position, and communicating with the outside when the stopper is in its open position.

9. A device according to claim 5, wherein the stopper head includes two diametrically opposite outwardly projecting radial pegs suitable for being received in diametrically opposite notches in the inside surface of the end of the collar in order to define the stopper closure position.

10. A device according to claim 6, wherein the stopper head includes two diametrically opposite outwardly projecting radial pegs suitable for being received in diametrically opposite notches in the inside surface of the end of the collar in order to define the stopper closure position.

11. A device according to claim 7, wherein the stopper head includes two diametrically opposite outwardly projecting radial pegs suitable for being received in diametrically opposite notches in the inside surface of the end of the collar in order to define the stopper closure position.

12. A device according to claim 8, wherein the stopper head includes two diametrically opposite outwardly projecting radial pegs suitable for being received in diametrically opposite notches in the inside surface of the end of the collar in order to define the stopper closure position.

* * * * *